United States Patent [19]

Hanna

[11] 4,163,303

[45] Aug. 7, 1979

[54] HINGE STRUCTURE

[75] Inventor: Gary D. Hanna, Toronto, Canada

[73] Assignee: G. D. Hanna Incorporated, Don Mills, Canada

[21] Appl. No.: 839,268

[22] Filed: Oct. 4, 1977

[30] Foreign Application Priority Data

Sep. 13, 1977 [CA] Canada ..... 286742

[51] Int. Cl.[2] ..... E05D 5/06; E05D 9/00

[52] U.S. Cl. ..... 16/135; 16/150; 16/DIG. 13; 24/204

[58] Field of Search ..... 16/135, 150, 151, DIG. 13; 24/204; 2/DIG. 6

[56] References Cited

U.S. PATENT DOCUMENTS

| | | | |
|---|---|---|---|
| Re. 28,672 | 1/1976 | Wakeman | 16/150 |
| 2,882,564 | 4/1959 | Couse et al. | 16/135 X |
| 3,009,235 | 11/1961 | De Mestral | 24/204 X |
| 3,386,128 | 6/1968 | Vyvyan | 16/150 |
| 3,695,330 | 10/1972 | Hasbrouck | 16/150 X |
| 3,696,472 | 10/1972 | Perina et al. | 24/204 X |
| 3,927,438 | 12/1975 | Blake | 16/150 |

FOREIGN PATENT DOCUMENTS

| | | | |
|---|---|---|---|
| 2139972 | 2/1973 | Fed. Rep. of Germany | 16/150 |
| 1030268 | 3/1953 | France | 16/150 |

OTHER PUBLICATIONS

Velcro "Pop-On", Velcro Corp., 681 Fifth Ave., New York, N. Y. 10022, Sep. 1972.

*Primary Examiner*—James Kee Chi

*Attorney, Agent, or Firm*—Irving M. Weiner; Pamela S. Austin; Melvin Yedlin

[57] ABSTRACT

A novel hinge of flexible material is provided which comprises a pair of end sections and an intermediate connecting section. The end sections are securable through various means including hook and loop filament material to one face of a structural element and to an oppositely-facing surface of a second structural element to permit movement of the two elements through approximately 360° relative to each other.

6 Claims, 3 Drawing Figures

FIG.1.
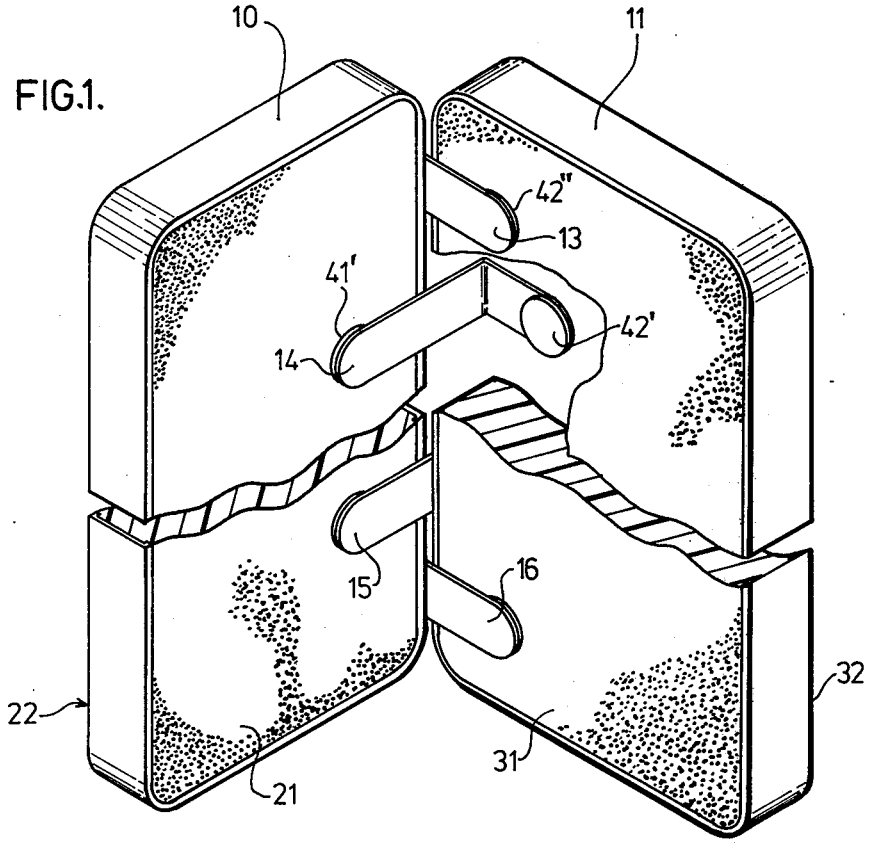
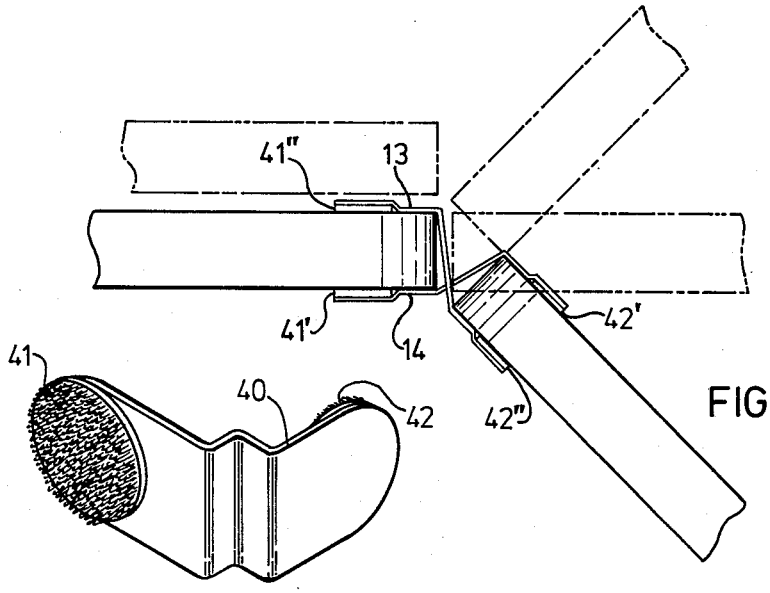
FIG.2.
FIG.3.

HINGE STRUCTURE

BACKGROUND OF THE INVENTION

This invention relates to hinges and more particularly to hinge structures for use in panel, wall or partitioning systems.

It has been common practice in all phases of the display and partitioning art to provide all manner of components to permit greater facility and adaptability in the use of any one particular system.

The most common type of structure comprises a series of planar panels to which various components may be secured. These panels and further panels may be secured to each other to provide or more usually to support additional vertical members or posts to which the panels or remaining structural elements must be secured.

The provision of a greater variety of elements while providing more flexibility in application, increases the general average cost to the user whose use of the alternatives is minimal and adds to the cost of manufacturing, shipping, erection and dismantling.

In the past, the connecting of these various panel components has been through various forms of joint or joining structures. For the most part, these hinges required either skilled workmen, tools and time, or one of them, to effect proper assembly. The provision of posts adds to the cost and the number of components.

It will also be evident that elements according to the invention eliminate the need for posts and reduce costs.

The advantages and features of the present invention will be more apparent from the following description and drawings in which a preferred embodiment is illustrated by way of example.

BRIEF DESCRIPTION OF THE DRAWINGS

FIG. 1 is a general perspective view partially broken away illustrating the relationship of the panels and hinge structure in accordance with the present invention.

FIG. 2 is a schematic plan view structure in accordance with the present invention and serves to illustrate the hinge movement.

FIG. 3 is a perspective view of a hinge in accordance with the present invention.

DETAILED DESCRIPTION

Referring now to the drawings, it will be noted in FIG. 1 that two panels, indicated at 10 and 11 are illustrated in partially broken away form to show the relationship between the panels and the remaining components. The hinges are illustrated at 13, 14, 15 and 16.

It should also be noted that the panels are shown relatively lengthy with respect to the hinge structures for clarity. In actual practice, the panels may range from four feet to eight feet or larger depending on the application, while the hinges will normally have dimensions in the order of inches or fractions of inches.

Again for ease of identification, panel 10 has two oppositely-facing surfaces identified as 21 and 22 and panel 11 has two corresponding oppositely-facing surfaces identified as 31 and 32.

In the embodiment illustrated in FIG. 1, surfaces 21, 22, 31 and 32 are of a hook, loop or hook and loop filamentous fabric which gives a pleasant, soundabsorbing and easy surface to which to secure the hinges.

As illustrated in FIG. 3, the preferred hinge comprises a relatively thin, wide member of flexible material.

In the present instance, the material is polyethylene although it will be understood that any equivalent material may be employed.

Adjacent either end of member 40, discs 41 and 42, having a filamentous hook and/or loop structure are secured. This may be secured in any well-known manner. However, it will be observed that discs 41 and 42 are mounted on opposite sides of member 40.

As illustrated in FIGS. 1 and 2, each hinge such as 13 and 14, 15 and 16 are mounted so that the adhering discs 41' and 42' in the instance of hinge element 14, and 41" and 42" in the instance of hinge element 13, are secured to opposed surfaces of their adjacent panel members 22 and 32.

It will be noted that the hinge member 40 is of a sufficient length so that the fastening is on opposed surfaces of the adjacent panels, that is on surface 21 of panel 10, and surface 32 of panel 11.

It will also be apparent that although a plurality of hinge elements are employed in the embodiment illustrated, in many circumstances at least two are normally required.

It is also apparent that the fastening of the member 40 may be other than by the hook/loop material.

Depending on the panel surface and depending on whether temporary or permanent connections are required in the hinge structures, the fastening may be either by temporary or permanent adhesives by alternate connecting means.

In FIG. 2, a schematic plan view relationship between two panels and the hinge elements is illustrated. One existing relationship is illustrated in solid outline and various alternatives are shown in dotted outline. As illustrated, without stretching, the two panel elements may be moved through substantially one parallel planar position to a second parallel planar position at 360° to the first.

In assembling the structures illustrated, the two panels are placed in end-to-end relationship and the hinge structures are simply placed on the surfaces as illustrated. The greater the pressure, then the greater the securement.

It will be seen that by adjusting the angular relationship between the panel members, a stable self-supporting structure is provided.

It will also be obvious that the panels may be folded one completely over on each other for facility in transportation.

In dismantling the panels one from the other, the fastening elements such as 41' and 42' are simply pulled apart and the panels separated.

It will of course be obvious that the number of panels and their form may be varied.

It will also be apparent that alternate structures than panels may constitute the structural elements.

The embodiments of the invention in which an exclusive property or privilege is claimed are defined as follows:

1. A hinge structure for hingedly securing first and second structural elements to permit movement thereof, one relative to the other through substantially 360°, each of said elements having a pair of corresponding sides, wherein:

said hinge comprises a relatively thin, wide band of substantially non-extensible material having opposite sides;

a first one of said hinge sides is releasably securable to a first one of said structural element surfaces and a second one of said hinge sides is releasably securable to a second one of said second structural sides, to hold said structural elements in at least an adjacent abutting relationship; and a pair of hook and loop filamentous fastening elements is secured one to one end of said hinge on a first side thereof and one to a second end of said hinge on the second side thereof, said hook and loop filamentous fastening elements being adapted to engage with and disengage from selective portions of corresponding hook and loop filamentous surfaces on corresponding opposed surfaces of said first and second structural members.

2. A hinged structure comprising, in combination:

first and second structural elements;

each of said structural elements having a pair of corresponding sides;

at least one hinge element connecting said first and second structural elements for movement, one relative to the other through substantially 360° C.;

said hinge comprising a thin, relatively wide band of substantially non-extensible material having opposite sides;

a first one of said hinge sides being releasably securable to a first one of said structural element surfaces and a second one of said hinge sides being releasably securable to a second one of said second structural element sides to hold said structural elements in at least an adjacent abutting relationship;

said structural elements having a hook and loop filamentous surface; and said hinge element including a pair of hook and loop filamentous fastening elements, one secured adjacent to one end of said hinge on a first side thereof and one secured to a second end of said hinge on the second side thereof, said hook and loop filamentous fastening elements being adapted to engage with and disengage from selective portions of the adjacent hook and loop filamentous surface on said structural elements.

3. A hinged structure as claimed in claim 2 including a plurality of hinge elements connecting said first and second structural elements, alternate ones of hinge elements being releasably secured to alternate first and second surfaces of said first structural elements and to alternate second and first surfaces, respectively, of said second structural elements.

4. A hinged as claimed in claim 1 wherein said thin, wide band is of flexible plastic.

5. A hinged structure as claimed in claim 2 wherein said thin, wide band is of flexible plastic.

6. A hinged structure as claimed in claim 3 wherein said thin, wide band is of flexible plastic.

* * * * *